United States Patent [19]

Thioulouse

[11] Patent Number: 4,808,880

[45] Date of Patent: Feb. 28, 1989

[54] DISPLAY MEANS WITH MEMORY EFFECT COMPRISING THIN ELECTROLUMINESCENT AND PHOTOCONDUCTIVE FILMS

[75] Inventor: Pascal Thioulouse, Paris, France

[73] Assignee: Centre National D'Etudes des Telecommunications, Issy-les-Moulineaux, France

[21] Appl. No.: 905,345

[22] PCT Filed: Dec. 11, 1985

[86] PCT No.: PCT/FR85/00361

§ 371 Date: Aug. 13, 1986

§ 102(e) Date: Aug. 13, 1986

[87] PCT Pub. No.: WO86/03871

PCT Pub. Date: Jul. 3, 1986

[30] Foreign Application Priority Data

Dec. 18, 1984 [FR] France ..... 84 19353

[51] Int. Cl.[4] ..... H05B 33/22

[52] U.S. Cl. ..... 313/507; 313/509; 340/825.81

[58] Field of Search ..... 313/499, 501, 503, 506, 313/507, 509; 315/167; 250/213 A; 340/825.81, 760, 781

[56] References Cited

U.S. PATENT DOCUMENTS 2,931,915 4/1960 Jay, Jr. ..... 313/509 X 3,358,185 12/1967 Lally .

3,711,719 1/1973 Szepesi ..... 313/507 X 4,035,774 7/1977 Chang ..... 340/825.81

FOREIGN PATENT DOCUMENTS 2335902 11/1976 France .

OTHER PUBLICATIONS

"The Use of Photoconductive CdS:Cu,Cl Thin Films in a Laser Addressed Electroluminescent Display Screen" Olive et al., *Thin Solid Films* 41(1977), 151-160.

"Hysteretic Thin-Film EL Devices Utilizing Optical Coupling of EL Output to a Series Photoconductor" Kitai et al., *SID* 84 *Digest* pp. 255-256.

"Device Characterization of an Electron-Beam-Switched Thin Film ZnS:Mn Electroluminescent Faceplate" Sahni et al., *IEEE Transactions on Electron Devices*, vol. ED 28 No. 10, Jun. 81, p. 708.

*Primary Examiner*—David K. Moore

*Assistant Examiner*—Sandra L. O'Shea

*Attorney, Agent, or Firm*—Oblon, Fisher, Spivak, McClelland & Maier

[57] ABSTRACT

An electroluminescent display with a memory effect. The display includes an electroluminescent layer and a photoconductive layer, both of which are thin films of approximately 1 micron. The two layers are placed between two systems of electrodes which are connected to a power source. Thin dielectric film may also be part of the assembly.

7 Claims, 2 Drawing Sheets

Figure 1:
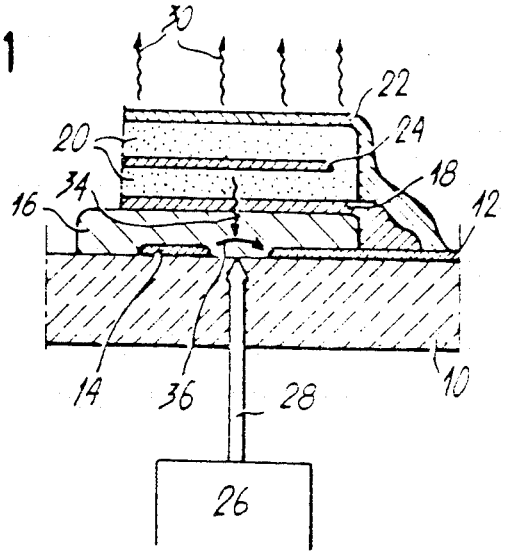

DISPLAY MEANS WITH MEMORY EFFECT COMPRISING THIN ELECTROLUMINESCENT AND PHOTOCONDUCTIVE FILMS

The present invention relates to a memory effect display means comprising thin electroluminescent and photoconductive films.

The interest of combining the properties of electroluminescent bodies and photoconductive bodies has long been recognized.

It is based on the possibility of obtaining a memory effect, which can be diagrammatically explained in the following way. A display means essentially comprises an electroluminescent layer (or a stack of layers comprising an electroluminescent layer which can be called a "electroluminescent structure") placed between two systems of electrodes, which are connected to driving circuits. A photoconductive layer can be arranged in series with the electroluminescent structure, so as to establish, under the effect of an optical excitation, an electrical conduction between certain of these electrodes. This conduction leads to the establishment of appropriate electrical potentials and the appearance of an excitation of the electroluminescent layer, which then emits radiation. The latter is mainly used for the display of information, but it also makes it possible to maintain the conduction of the photoconductive layer, even after the end of optical addressing. Thus, there is auto-maintenance or, in other words, a memory effect.

In an article entitled "The use of photoconductive CdS:Cu-cl films in a laser-addressed electroluminescent display screen" published in the journal Thin Solid Films, 41, 1977, pp 151–160, by G. OLIVE et al was described a device of this type and its structure is diagrammatically shown in the attached FIG. 1. On an insulating, transparent support 10 are deposited opaque electrodes (Au) 12 and 14, a photoconductive material layer 16 and a transparent electrode 18 connected to electrode 12. An electroluminescent material 20 covers electrode 18. A transparent electrode 22 is connected to electrodes 12 and 18 and an opaque electrode (Al) 24 is placed in the electroluminescent material, in such a way that the latter is inserted between on the one hand electrode 24 and on the other the two electrodes 18, 22. Laser 26 is able to emit a light beam 28, which strikes the photoconductive material 16 in the area located between electrodes 12 and 14.

This device functions in the following way. In the inoperative state, an a.c. voltage is applied to electrode 24 and electrode 14, but laser 26 is stopped. The photoconductive material 16 is not optically excited and its behaves like an insulator. Thus, electrodes 14 and 12 are electrically insulated from one another and the potential of electrode 12 floats, as does that of electrodes 18 and 22. The electroluminescent material is not excited and consequently emits no light.

Excitation is optically controlled by laser 26, which emits a beam 28, which strikes photoconductor 16 between electrodes 12 and 14 making said zone electrically conductive. The two electrodes 12 and 14 are then connected by a conductor channel (symbolically indicated by arrow 36) and the potential of electrodes 12, 18 and 22 is established at the value fixed by the potential applied to electrode 14. A potential difference then appears between electrode 24 on the one hand and electrodes 18 and 22 on the other. This leads to the appearance of an electric field and the excitation of the electroluminescent material. The radiation 30 emitted by the electroluminescent material towards the front of the device makes it possible for information to be displayed by an observer at 32. With respect to the rear part 34 of the emitted radiation, it excites the photoconductor and maintains the photoconduction thereof. The laser 26 can then be placed in the inoperative state without the electroluminescence stopping, giving a memory effect. The display stops on eliminating the electrical excitation.

A somewhat identical device was described by A. H. KITAI et al in an article entitled "Hysteretic Thin-Film EL Devices Utilizing Optical Coupling of EL Output to a Series Photoconductor", published in the journal SID 84 DIGEST, pp 255–256.

The complexity of the prior art devices is largely due to the fact that the photoconduction is realized longitudinally or in the plane of the layers. This is what is stressed by arrow 36 in FIG. 1. Thus, it is necessary to have two systems of electrodes, one (like 14) formed by addressing electrodes and the others (like 18 and 22), which constitute exciting electrodes.

These electrodes are also not of the same sizes, because their functions differ, the first being much narrower than the second, which leads to masking and alignment problems. Moreover, in the device by G. Olive et al, the electroluminescent structure 20 comprises two similar electroluminescent layers separated from an electrode 24 acting as an optical screen for electrically insulating the photoconductor element against the incident ambient light on the device from the side of the observer. This principle requires a group of electrodes on four separate levels, imposing several supplementary masking, etching and deposition stages in the production process.

In addition, FR-A-2 335 902, discloses an electroluminescent display means with a memory effect comprising a photoconductive material layer placed between first and second electroluminescent material layers. The first electroluminescent layer has a light emission band within the limits of the excitation band of the photoconductive layer. The second electroluminescent layer has a light emission band outside these limits and which is in principle in the visible part of the spectrum and which can be used for display purposes.

When a relatively low maintaining voltage is applied across the first and second electroluminescent layers surrounding the photoconductive layer, the electroluminescence emanating from these layers is relatively weak, due to the fact that there is a large drop to the excitation voltage in the photoconductive layer, which has a high impedance due to the relatively weak luminescence of the first electroluminescent layer. During the application of a commutating or switching voltage, there is an increase in the light emission from the first electroluminescent layer, which has the effect of exciting the photoconductive layer. Therefore an electrooptical reaction is obtained between said first electroluminescent layer and the photoconductivity layer, the switching voltage drop occurring in the photoconductive layer decreasing rapidly, whilst the voltage drop occurring in the first and second electroluminescent layers increases rapidly. When the photoconductive material is in the state where it is completely conductive, the means is brought into the stable active state and the maintenance voltage leads to the generation, by the first electroluminescent layer, of an electroluminescence adequate for ensuring that the photoconductive material remains completely conductive, even when a switching voltage is no longer applied.

Although these means are simpler than those described hereinbefore, they are still complex due to the presence of two electroluminescent layers and the need of having different optical characteristics for these layers.

The object of the present invention is to further simplify such means, whilst improving their performance characteristics and production conditions. Thus, the invention provides for the use of an electroluminescent layer (or a stack of layers comprising an electroluminescent layer) and a photoconductive layer, which are all in thin film form, i.e. films having a thickness of approximately 1 micron or less and in practice between 0.1 and 2 microns.

The following interesting advantage results from the thinness of the electroluminescent film. The electroluminescent films deposited on a smooth, planar substrate (e.g. glass substrate) are themselves smooth and planar and then form the seat of an effect which is commonly called optical guidance or light trapping. Although the luminance levels extracted from the means are of the same order for means based on thin films as for those based on non-thin films, i.e. "powder" (typically 100 to 1000 $Cd/m^2$ at 1 kHz excitation), the internal luminous fluxes are much more intense in thin film structures (typically by a factor of 10) as a result of the light trapping effect and the absence of optical diffusion. In the stack of an electroluminescent structure and a photoconductive layer, where the electroluminescent structure is a thin film or a stack of thin films, the light emission of the active layer is quasi-integrally trapped ($\simeq$90%) and largely transferred to the photoconductive layer, hence a distinctly reinforced memory effect.

The coupling between the electroluminescent and photoconductive materials being reinforced in this way, the means becomes substantially insensitive to ambient light. The complication of the device according to FR-A-2 335 902 becomes pointless.

Another advantage resulting from the use of thin films for the electroluminescent structure is that the light is not diffused by the films and the rear photoconductive film, which has a dark appearance, leads to an excellent display contrast.

Another advantage resulting from the invention is that the photoconductive film is uniformly deposited over the entire surface of the display and absorbs most of the incident ambient light, thus preventing the reflection of the latter onto the generally opaque and metallic electrode system 48. Thus, it contributes to considerably increasing the contrast of the means according to the invention. In the prior art devices, like that of G. Olive et al, the contrast is reduced for two reasons. Firstly the electroluminescent material is powder based, i.e. highly diffusing and secondly the device is constituted by several system of metallic electrodes 12 and 24 not masked by the photoconductive layer and which would therefore reflect the incident ambient light.

Two properties result from the thinness of the photoconductive film. Firstly for a very thin film, typically with a thickness below 0.5 micron, in the switched off state of the means, the darkness resistance of the photoconductive film is high compared with the impedance related to the capacity of the film and consequently does not influence the voltage at the terminals of the film. In other words, the photoconductive film has a capacitive rather than resistive electrical behaviour, so that this is no longer dependent on the resistivity of the material in the dark. Thus, the means could be switched to an on state by a purely electrical means. Even better, the hysteresis loop then becomes independent of the resistivity of the photoconductive material in the dark. Thus, the production of the means is facilitated and obtaining the hysteresis is much more reproducible. Secondly for a photoconductive film thickness below 1 to 2 $\mu$m and for a voltage in the dark at the terminals of the photoconductive film of 20 to 50 V, the electric field in the photoconductive film is then a few $10^5$ V/cm. This gives significant nonlinear effects in the conductivity of the photoconductor (as is particularly the case with amorphous Si, whose electrical behaviour is described in the article by I. Solomon et al "Space-charge-limited conduction for the determination of the midgap density of states in amorphous silicon: Theory and experiment", Phys. rev. B30, p 3422, 1984). These effects are similar to those of an avalanche effect (although it is not an avalanche in the strict sense) and they can be compared with the effect obtained with two diodes placed head to tail. More specifically, the conduction current in the photoconductive film, of low value below a certain voltage threshold, increases suddenly above this threshold. The practical interest is that the voltage at the terminals of the photoconductive film in the dark is in fact the threshold voltage of the "avalanche", which is much less dependent on the production parameters than the low electric field resistivity (e.g. case of thick photoconductive layers) and is therefore particularly reproducible. A major advantage common to both the two aforementioned cases is that, as the photoconductive film is very resistive, any stray coupling between neighbouring image elements by planar conduction in the photoconductive film is avoided, even at high resolutions (typically up to 10 points/mm).

With regards to the systems of electrodes used, they can be of different types as a function of the envisaged application. In the case of a matrix display screen, the systems of electrodes are constituted by two groups of conductive strips, the strips of one of the systems crossing those of the other system. The volume defined by each intersection between an electrode of one system and an electrode of the other constitutes an image or picture element. One image can then be displayed on a matrix screen of this type by exciting a certain number of these image elements. A well known display method for the matrix screen is the "one row at a time method", by which excitation or driving of the rows (one of the two systems of electrodes) takes place successively and sequentially, whilst the columns (the other system of electrodes) are simultaneously excited at the same time.

In such a variant, the optical excitation making the material photoconductive is obtained by the light emitted by the electroluminescent film itself under the action of an electrical excitation temporarily exceeding a certain threshold, so that the addressing of the means is completely electrical.

However, according to another variant, the means can comprise a specific optical addressing device able to bring about the conduction of certain zones of the photoconductive film. This optical device can be a laser, a "light pen" or any other light source.

According to yet another variant, the addressing means can be an electron beam. The device in question will be very similar to that described in the article entitled "Device Characterization of an Electron-Beam Switched Thin-Film Zns:Mn Electroluminescent Faceplate", published by O. Sahni et al in "IEEE Transactions on Electron Devices", vol. ED 28, No. 10, June 81, p. 708. The addressing means then consists of a single electroluminescent element covering the entire rear surface (electron gun side) of the front face of a cathode tube and supplied independently of the gun. The invention involves the addition of a photoconductive film of the same surface as that of the electroluminescent film or films and inserted between the latter and the rear Al electrode.

The absorption spectrum of the photoconductive material must be adapted to the emission spectrum of the electroluminescent element in order to ensure that the latter has a maximum sensitivity at said electroluminescent emission. It can be constituted by the aforementioned materials used in such means, i.e. CdS, CdSe, or CdS—CdSe, or CdS:Cu,Cl. Thus, with Cds—CdSe, the inventor has been able to obtain switching of approximately 1 millisecond with electrical switching; A. H. KITAI et al giving an electric switching time of 20 ms.

However, according to the invention, it is also possible to use another material, whose photoconductivity has already been recognized, but which has never been used in memory electroluminescent means, probably because the photoconductivity is well below that of the aforementioned materials, which made it unusable in the prior art devices, for which the conduction is in the plane of the layers. This is hydrogenated amorphous silicon (a—Si:H). The interest of this material is due to its response speed and its ability to resist high electric fields, as has been shown by intense studies carried out on this material for producing solar cells and thin film transistors. Recent work carried out by the inventor has revealed that it is possible to reduce the switching time to 0.1 ms, which is very important meaning that for a display screen with 250 sequentially excited rows, it would be necessary to have $250 \times 0.1 = 35$ ms for addressing a screen, which is compatible with the speeds of video systems, which was not the case with the prior art devices.

The maintenance of the on state for a switched display element must be carried out between individual half cycles of the maintenance voltage. It can be obtained in two ways which are not exclusive of one another. If the decline time of the light emitting doping centre is sufficiently slow to permit an overlap of the light pulses between individual half cycles of the maintenance voltage, the photoconductive film will also be subject to the tail of the luminescence of the light emission preceding the new half cycle or electric pulse and the means will remain in the on state. If the delay time of the emitter centre is too short or the frequency of the maintenance voltage too low, it would then be necessary to choose a photoconductive material having a sufficiently slow response time to permit the maintenance of the on state of the means.

Thus, by choosing the photoconductive material and matched production conditions, it is possible to obtain means with fast switching times making it possible to operate at video speed over a large number of rows or, conversely, means operating at low maintenance frequency and therefore having a low electric power consumption. It is also possible to advantageously use another material, namely zinc monoxide (ZnO).

The feature of the invention can better be gathered from the following description of non-limitative embodiments and with reference to the attached drawings, wherein show:

FIG. 1, already described, a prior art device.

Figure 2:
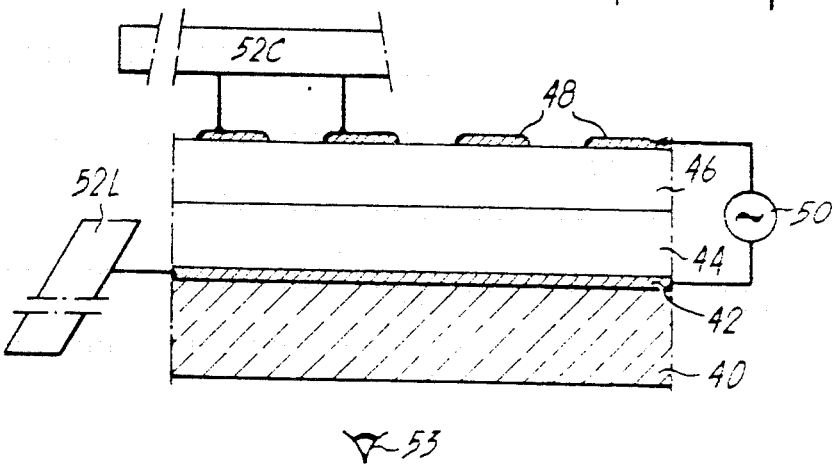

FIG. 2, in section along a row electrode, a means according to the invention in an embodiment where addressing is all electrical.

Figure 3:
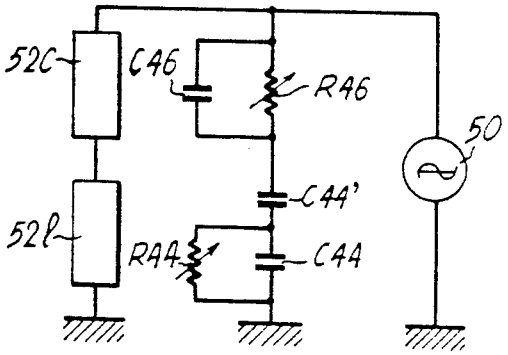

FIG. 3, a diagram showing the electrical equivalent of a display element.

Figure 4:
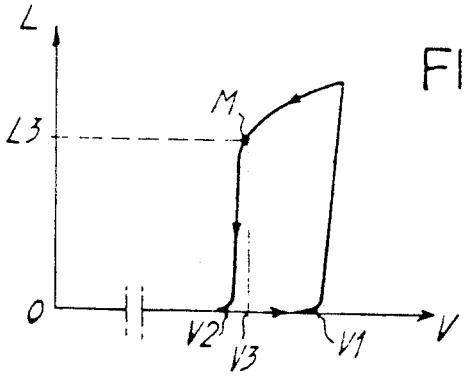

FIG. 4, a graph showing how the luminance of a display element changes as a function of the voltage applied.

Figure 5:
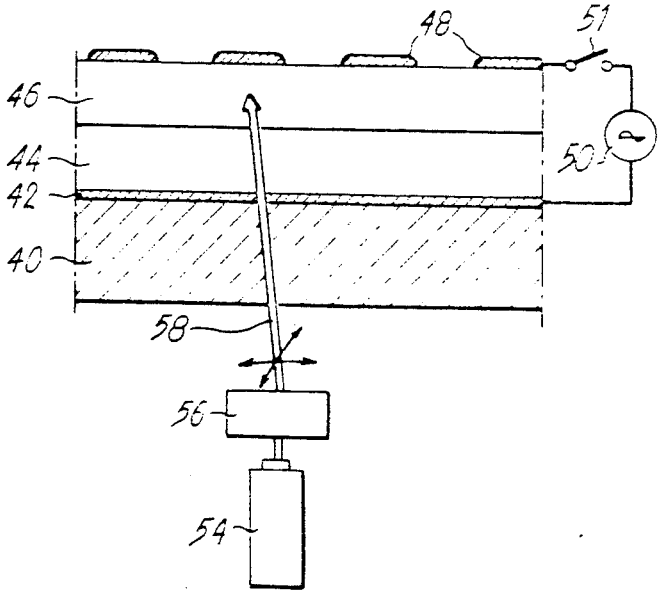

FIG. 5, another embodiment where addressing is optical.

Figure 6:
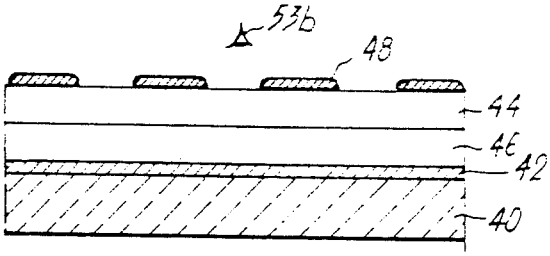

FIG. 6, in a section along a row electrode, a means according to the invention in a reversed embodiment compared with that of FIG. 2.

FIGS. *7a, b, c* three variants of an electroluminescent film—dielectric layers—photoconductive film stack.

In those of the drawings showing the means according to the invention in cross-section, the films are not shown to scale for reasons of clarity. It is merely pointed out again that the photoconductive film and electroluminescent film, as well as other possible films of the electroluminescent structure generally have a thickness of about 1 micron (in practice between 0.1 and 2 microns). Electrodes 42 are conventionally produced by the deposition of an indium-tin oxide film (ITO) with a typical thickness of 0.2 micron. The insulating substrate can be of glass, e.g. glass 7059 marketed by Corning or an ordinary soda-lime glass. Electrodes 48 can be opaque and can be e.g. produced by aluminum deposition, or can be transparent and produced e.g. by ITO deposition.

The means shown in FIG. 2 comprises a transparent substrate 40, row transparent electrodes 42 (the section shown is supposed to be along one of these rows), a thin electroluminescent film 44, a thin photoconductive film 46 and column electrodes 48. The electroluminescent film can be replaced by a stack of films comprising an electroluminescent film. The other films can be dielectric layers or films for an electroluminescent structure of the thin film type with alternating excitation, or a resistive protective film or layer for a thin film structure with unidirectional excitation. The row and column electrode systems are permanently connected to an a.c. voltage generator 50, the voltage applied being called the maintenance voltage. Moreover, the row electrodes 42 are connected to a row addressing circuit 52L and the column electrodes 48 to a column addressing circuit 52C. These circuits can be positioned in parallel with the generator 50, as shown in FIG. 3, or in series. Observation preferably takes place across substrate 42 at 53.

The operation of the said means will be explained with reference to FIGS. 3 and 4. In the first, it is possible to see the equivalent electric diagram of a display element, i.e. the parallelepipedic volume between a row electrode and a column electrode. The photoconductive film is electrically equivalent to a variable resistor R46 and a fixed capacitor C46. The electroluminescent film 44 is equivalent to a variable resistor R44 and a fixed capacitor C44. A supplementary capacitor C44' represents the contribution of one or more dielectric layers generally deposited on and/or in front of the electroluminescent film (as will be shown hereinafter relative to FIG. 7).

The graph of FIG. 4 shows the variation of the luminance L emitted by a display point as a function of the voltage V applied between the eletrode surrounding or framing said point. The luminescence does not appear when said voltage has not reached a value V1 corresponding to a certain electric field threshold necessary for obtaining the electroluminescence phenomenon. As from this value, the excited point emits light. The rear part of the light radiation emitted by film 44 strikes photoconductor 46 which, from the insulator which it was (high resistance R46) becomes conductive (low resistance R46). Virtually all the voltage is then applied to the electroluminescent film 44 and the electric field applied in this film increases suddenly. Thus, the voltage can be reduced without the electroluminescence stopping. The latter will only disappear when the field has dropped below the threshold value, which corresponds to a voltage V2 below V1. If the voltage applied to the electrodes is equal to a value V3 between V1 and V2, the display is maintained. Generator 50 supplies the voltage V3 permanently applied to the electrodes. The function of the addressing circuits 52L and 52C is to supply, for a short time and to the element which it is wished to excite, a voltage increase having an amplitude equal to or higher than V1–V3. In order to extinguish or switch off an emitting element, it is merely necessary to apply a clearing pulse, which for a short time brings the voltage below V2. Generator 50 can be a sine-wave generator, but pulse or square-wave signal generators are also suitable.

The means described hereinbefore has the special feature of having solely electrical addressing. However, optical addressing means also falls within the scope of the invention. Such a means is shown in FIG. 5. As shown, it still comprises a substrate 40, row electrodes 42, a thin electroluminescent film 44, a thin photoconductive film 46, column electrodes 48 and a generator 50, but the addressing means is here constituted by a laser 54 and a deflecting device 56. The latter can be produced with the aid of a galvanometer mirror or a fibre bundle. The optical addressing means can also be a light pen. The light beam 58 can be directed on to any one of the display elements defined by the overlap of two electrodes of systems 42 and 48. The optical excitation of one of the points makes the film 46 conductive in said zone, which leads to a drop in the equivalent resistance R46. The voltage of source 50 still being equal to V3, the electroluminescent material is excited by a field, whose value exceeds the electroluminescence threshold, which leads to the emission of electroluminescence and the switching of the point into the on state. For all the other points, voltage V3 is inadequate to bring about electroluminescence. As the complete image is displayed, the latter could be eliminated by switching off a switch 51, which stops the maintenance excitation.

The means shown in FIG. 6 is identical to that of FIG. 2, except that the thin electroluminescent film or stack of thin films having an electroluminescent film 44 is located on top of the thin photoconductive film 46 and the column electrodes 48 are necessarily transparent. Observation preferably takes place through electrodes 48 at 53*b*. Such a structure may be necessary, e.g. if the conditions under which the photoconductive film is deposited are of such a nature as to deteriorate the characteristics of the film or films forming the electroluminescent element, it then being preferable to deposit the latter second.

Figure 7:
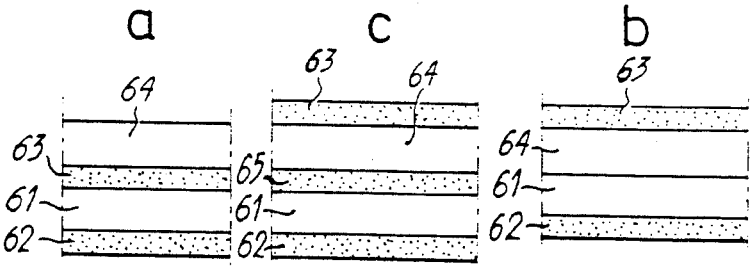

FIG. 7 shows that in practice the electroluminescent and photoconductive films can be associated with dielectric layers. At a, the electroluminescent film 61 is surrounded By dielectric layers 62, 63, the photoconductive film 64 being deposited on the upper dielectric layer 63. These films have refractive indices which differ significantly in practice and which lead to important light trapping effects. These effects can be defined with respect to a specific case. The electroluminescent film 61 can be of ZnS with an index $n_Z=2.3$ approximately. The dielectric films or layers 62 and 63 can be of $Y_2O_3$ of approximate index $n_D=1.9$. The photoconductive film 64 can be of a—Si:H with an approximate index of 3.4. The index of the glass substrate and transparent electrodes is typically 1.5. The application of the refraction law (retaining the product n·sin $\theta$ from one medium to the other) gives the following results. If $\phi_z$ is the luminous flux emitted within ZnS and L, the luminance measured in the air normally to the plane of the substrate on the observer side, it is calculated that:

$$L(\mathrm{Cd/m^2}) \simeq \frac{\phi_Z\,(\mathrm{lux})}{2\pi} \times \left(1 - \sqrt{\frac{n_Z^2 - 1}{n_Z^2}}\right) \tag{1}$$

If $\phi_{PC}$ is the illumination of the photoconductive film induced by the emission $\phi_Z$ of ZnS, we obtain:

$$\phi_{PC} \simeq \frac{\phi_Z}{2}\left(1 + \sqrt{\frac{n_Z^2 - 1}{n_Z^2}} - 2\sqrt{\frac{n_Z^2 - n_D^2}{n_Z^2}}\right) \tag{2}$$

The only easily measurable quantity is L and from (1) and (2) is deduced:

$$\phi_{PC}(\mathrm{lux}) = \pi L(\mathrm{Cd/m^2}) \times (n_Z + \sqrt{n_Z^2 - 1} - 2\sqrt{n_Z^2 - n_D^2})/(n_Z - \sqrt{n_Z^2 - 1}) \tag{3}$$

In the specific case envisaged, we obtain:

$$\phi_{PC}(\mathrm{lux}) \simeq 7.8\pi L(\mathrm{Cd/m^2}) \tag{4}$$

In a structure of the type according to the invention and assuming a complete absorption of the incident light on the photoconductive film by the latter, L will have a typical value of 300 Cd/m$^2$ at an excitation frequency of 1 kHz for ZnS:Mn. The illumination $\phi_{PC}$ received by the photoconductive film will consequently be $\simeq$7,300 lux. The ambient illumination typical of a working station in the interior is approximately 400 lux, which is much below $\phi_{PC}$.

The optical screen described in the article by G. OLIVE et al referred to hereinbefore and which causes numerous technological complications is consequently unnecessary with the means according to the invention. This is due to the excellent optical coupling between the electroluminescent film and the photoconductive film and also the intense luminous flux emitted in thin film ZnS:Mn. The optical coupling between the electroluminescent film and the photoconductive film can be further improved by choosing high refractive index dielectrics, such as e.g. $Ta_2O_5$ ($n \simeq 2.1$) or ferroelectric material such as $PbTiO_3$ ($n \simeq 2.7$).

On returning to FIG. 7*b*, at b, the electroluminescent and photoconductive films 61 and 64 are in contact with one another, but the assembly is protected by a lower dielectric film 62 and an upper dielectric film 65. In this case, the optical coupling between the electroluminescent film and the photoconductive film is of a maximum nature and the integrality of the flux radiated by the electroluminescent film and not extracted from the structure in air is recovered by the photoconductive film. Calculation takes place by:

$$\phi_{PC} \simeq \frac{\phi_Z}{2}\left(1+\sqrt{\frac{n_Z^2-1}{n_Z^2}}\right) \quad (5)$$

and $$\phi_{PClux} \simeq \pi L_{(Cd/m2)} \times \frac{n_Z+\sqrt{n_Z^2-1}}{n_Z-\sqrt{n_Z^2-1}} \quad (6)$$

In the example of a ZnS electroluminescent film and $Y_2O_3$ dielectric films, we obtain:

$$\phi_{PC}(\text{lux}) \simeq 19\pi L(\text{Cd/m}^2) \quad (7)$$

A luminance L of 300 Cd/m$^2$ gives an illumination $\phi_{PC}$ of the photoconductive film of approximately 18000 lux. The use of such a device without an optical screen and on the outside (illumination below 10,000 lux) then becomes possible.

At c, the means shown is obtained from the means shown at b by interposing a supplementary dielectric layer or film 65. This type of structure has several advantages. It is firstly known that multifilm dielectrics have electrical and protective properties under a strong field superior to those of a single dielectric film. Moreover, the electrical properties of the electroluminescent structure (threshold voltage, threshold rigidity) are very sensitive to the nature and quality of the interfaces between the actual electroluminescent film and the adjacent films. The dielectric of film 65 will be chosen in such as way as to optimize its interface with the electroluminescent film. It would also be possible to choose a dielectric with a high refractive index to come as close as possible to the optimum optical coupling in accordance with the well known principle of anti-reflection layers. Another original and simpler means to be realized for obtaining the maximum optical coupling is to deposit a film 65 which is thin enough to permit said coupling by evanescent waves. Thus, to a light wave emitted in the electroluminescent film and having an incidence angle with the interface between the electroluminescent film and the upper film 65 greater than the critical angle defined by the refraction law, is associated an evanescent wave in film 65, whose wave function is characterized by:

$$\Psi = \Psi_o e^{-k(n_{eff}2-n2)x},$$

with $k=2\pi/\lambda$, in which k is the number of waves, $\lambda$ the emission wavelength, n the index of film 65 and $n_{eff}$ the effective index of the cavity formed by the electroluminescent film and films 65 and 62: $n_{eff} \simeq n_z$. The axis of x is normal to the plane of the films and has its origin the interface between electroluminescent film and film 65. For a ZnS electroluminescent film and a $Y_2O_3$ film 65, it is possible to calculate:

$$\Psi = \Psi_o e^{-x/1}$$

with 1=500 Å.

Thus, on choosing a $Y_2O_3$ film 65 with an approximate thickness of 0.05 micron, a fraction $1/e^2$ of the incident light power on the interface between the electroluminescent film and film 65 is transmitted on each reflection to the photoconductive film. Thus, there is a quasi-integral transfer of the light wave from the electroluminescent film to the photoconductive film following a few reflections, despite the relatively low index of the $Y_2O_3$ film 65.

The means according to the invention offers another advantage in the display field. Thus, it makes it possible to take better advantage of the memory effect encountered in certain electroluminescent means. Thus, it is known that certain electroluminescent materials containing manganese have a memory effect (independently of the presence of any photoconductive material). This effect was described in an article entitled "Character Display using Thin-Film EL Panel with Inherent Memory" published by CHUJI SUZUKI et al in SID 76 DIGEST, pp 50–51. However, this memory effect is much more difficult to master than that realized in the present invention for the reasons given hereinafter.

1. In the prior art inherent memory means, the width of the hysteresis layer or film cannot be easily adjusted. In addition, the hysteresis effect progressively disappears with prolonged operation. In the case of the cell according to the invention, only the photoconductor is responsible for the hysteresis (cf. curve of FIG. 6), so that its properties can be optimized separately from the electroluminescent film.

2. The inherent memory effect is only obtained at high manganese concentrations (typically above 1% by weight). However, these concentrations are beyond the optimum value for which the electroluminesence efficiency is highest. This efficiency then drops to one third or even to one tenth of its maximum value. The electroluminescent material-photoconductive material combination according to the invention, by separating the luminescence and memory functions, makes it possible to adopt for manganese the concentration optimum, with regards to the luminescence efficiency. A gain of an order of magnitude is consequently possible on the luminance of the means.

3. With the invention, the memory effect can be obtained, even if the dopant of the electroluminescent film is not manganese. Thus, colours other than yellow (which corresponds to Mn) are possible. It is known that the memory effect makes it possible to excite the electroluminescent element with a maintenance voltage with a frequency much higher than the refreshing frequency of an electroluminescent screen without memory, normally 1 kHz compared with 100 Hz for the second case. This frequency and therefore luminance gain of an order of magnitude is even more appreciated as the electroluminescent efficiencies of materials emitting in colours other than yellow are much lower.

4. For reasons which have not as yet been fully explained, certain technologies do not make it possible to obtain a memory effect appropriate for the electroluminescent film. Thus, as far as is known to the inventor, there is no ZnS:Mn inherent memory effect when the latter is deposited by Joule effect evaporation, cathodic sputtering or the atomic layer expitaxy method developed by LOHJA (Finland). The invention makes it possible to obviate this disadvantage by providing a specific means for introducing the memory effect.

It is again necessary to stress another advantage of the invention. If the photoconductive material is sufficiently resistant to high electric fields, a thinner photoconductive film 46, e.g. below 1 micron is deposited and a high capacitive coupling takes place between the electrode on the photoconductive film and the electroluminescent structure (coupling represented by capacitor C46 in FIG. 3). This coupling permits a switching on of the means, even in total darkness, where the resistivity of the conductor is very high. The value of such a capacitance essentially depends on the thickness of the photoconductive film and the permittivity of the material. However, these magnitudes are completely uniform over the entire surface of a device and are reproducible between fabrication runs. However in a prior art device, like that of FIG. 1, it is much more difficult to ensure uniformity over a large surface and the reproducibility of the resistivity of the photoconductor in the dark. In this case, there are very wide dispersions in the control voltages. It is for this reason that an optical addressing means is normally used (laser 26 of FIG. 1). However, in the invention, an all electric addressing screen is perfectly reliable.

The photoconductive element can have a photoresistance behaviour in such a way that, at a given illumination level, it behaves like a resistor—R46 in FIG. 3—and its resistance will depend on the illumination level alone and not on the voltage at the terminals. It is recognised that it is difficult to ensure an excellent reproducibility of the resistivity of a photoconductor in the dark, the underlying mechanisms generally being not very well known and undesired impurities of a poorly known nature can e.g. modify this resistivity. Without capacitive coupling added to the resistor R46 of the photoconductive element, the switching on the device in the dark will be very difficult, the switching on or igniting voltage $V_1$ having to be very high in certain cases. This voltage appears integrally at the terminals of the electroluminescent element following the triggering or activation of the latter and can even lead to the destruction thereof. Voltage Vhd 1 will also be very sensitive to stray illumination, such as ambient illumination.

An original solution proposed by the invention is the use of a photoconductor with a photodiode behaviour. Such a behaviour can be obtained by adapting the process for producing the photoconductive film, so as to make it very resistive in the dark and by applying electric fields thereto. Thus, a means comprising an electroluminescent structure and a photoconductive film of a—Si:H of type $N^+$—I—$N^+$ (I:intrinsic) and tested by the inventor has revealed properties similar to those of FIG. 4, the "avalanche" voltage ($v_1$) at the terminals of the photoconductive film in the dark being approximately 20 V for a 2 μm thickness of the photoconductive film and corresponding to a field of approximately $10^5$ V/cm. This field value is characteristic of the material and is reproducible between individual samples. An electroluminescent-photoconductor means integrating a photoconductor element of the photodiode type can be represented as in FIG. 3, but with a photoconductive element equivalent to two diodes arranged head to tail with characteristics variable according to the illumination, in the non-restrictive case where the electroluminescent element is of the alternative excitation type. The width of the hysteresis $V_1-V_2$ (FIG. 4) is at the most equal to $v_1$ and is reproducible. The conduction of the photoconductor at $v_1$ is linked with mechanisms resembling the avalanche phenomenon and which are not directly connected with the photoconductivity of the material. Thus, voltage $v_1$ is not sensitive to low illumination levels. In practice, the maintenance voltage at the terminals of the photoconductor prior to the triggering of the device is approximately 20 to 50 V. Moreover, the electric protection layers of the electroluminescent element, like the dielectric layers for the electroluminescent type with thin films and alternative excitation and like the resistive film for the electroluminescent type with unidirectional excitation will effectively protect the photoconductive film. Thus, as a first approximation, it can be considered that for obtaining the current necessary for igniting or switching on the electroluminescent element, if the device is not switched on, it is necessary to apply a voltage $v_1$ to the terminals of the photoconductive element. If the device is already switched on, a lower voltage $v_2$ will be sufficient. Thus, it is shown that the hysteresis width $V_1-V_2$ is equal to $v_1-v_2$ and that the photoconductive element is protected by the electroluminescent element, the latter acting as a current limiter, said protection being distributed over the entire surface of the photoconductor in the case of the invention.

I claim:

1. Electroluminescent display means with a memory effect comprising, on an insulating support (40), an electroluminescent film (44) and a photoconductive film (46) stacked on one another, the assembly of said two films being placed between two systems of electrodes (42, 48), the latter being connected to an electric power source (50) permitting the excitation of certain zones of the electroluminescent film, characterized in that the electroluminescent film (44) and the photoconductive film (46) are thin films having a thickness of approximately 1 micron.

2. Means according to claim 1, characterized in that the electroluminescent film is a stack of a thin electroluminescent film and thin dielectric films.

3. Means according to claim 2, characterized in that the photoconductive film is placed between the electroluminescent film and a dielectric film.

4. Means according to claim 3, characterized in that an additional thin dielectric film is placed between the photoconductive film and the electroluminescent film.

5. Means according to claim 1, characterized in that an optical excitation initially making the photoconductive material conductive is obtained by the light emitted by the thin electroluminescent film, which is itself under the effect of an adequate electrical excitation applied to the two systems of electrodes, so that the addressing of the means is all electric (52C, 52L).

6. Means according to claim 1, characterized in that the photoconductive material is hydrogenated amorphous silicon.

7. Means according to claim 1, characterized in that the photoconductive film is CdS, CdSe or ZnO.

* * * * *